US006409236B1

(12) United States Patent
Steele

(10) Patent No.: US 6,409,236 B1
(45) Date of Patent: Jun. 25, 2002

(54) PORTABLE DOOR LOCK

(76) Inventor: Derek D. Steele, 16 Appletrees Pl., Cinder Path, Woking, Surrey GU22 0HD (GB)

( * ) Notice: Subject to any disclaimer, the term of this patent is extended or adjusted under 35 U.S.C. 154(b) by 0 days.

(21) Appl. No.: 09/574,589

(22) Filed: May 18, 2000

(51) Int. Cl.[7] ..... E05C 1/02; E05C 3/02
(52) U.S. Cl. ..... 292/291; 292/298
(58) Field of Search ..... 292/288–291, 292/293, 294, 296–298

(56) References Cited

U.S. PATENT DOCUMENTS

| | | | | |
|---|---|---|---|---|
| 124,503 | A | * | 3/1872 | Melendy |
| 710,118 | A | * | 9/1902 | Prud'homme |
| 1,477,731 | A | | 12/1923 | Urlich |
| 1,671,454 | A | | 5/1928 | Stoutenburgh |
| 1,888,425 | A | | 11/1932 | Dowling |
| 2,288,022 | A | | 6/1942 | O'Brien et al. |
| 2,461,398 | A | * | 2/1949 | Sands |
| 4,043,578 | A | * | 8/1977 | Downs |
| 6,036,242 | A | | 3/2000 | Lin |

* cited by examiner

*Primary Examiner*—Flemming Saether
(74) *Attorney, Agent, or Firm*—Janet Sleath

(57) ABSTRACT

The present invention is a portable door lock which comprises a bracket having a protrusion capable of insertion into a lock chamber of a doorframe. The bracket is connected by means of a hinge to a threaded bolt, upon which a hinged brace is slidably mounted. The hinged brace comprises a first member, which is adapted to be pressed against the door, pivotally connected to a second member, which is adapted to be pressed against the doorframe. A spring is mounted upon the first member and engages the second member, urging the second member away from the first member. The second member is provided with a stop which engages the first member. A thumbwheel is mounted upon and threadably engages the threaded bolt, effectively retaining the hinged brace upon the threaded bolt.

15 Claims, 5 Drawing Sheets

PORTABLE DOOR LOCK

TECHNICAL FIELD OF THE INVENTION

The present invention relates to door locks and, more particularly, to portable door locks for use independently of the lock generally provided on a door.

BACKGROUND OF THE INVENTION

Portable door locks, for use in addition to or in place of the conventional lock and key generally provided on a door, have been known in the prior art for sometime. However, many such locks are relatively weak and may be easily damaged when an intruder attempts to break in through the door. In addition, many portable door locks are difficult to apply to and remove from the door, making it hard for an occupant to quickly exit the room in the event of an emergency. There thus remains a need in the art for a portable door lock that is both strong and convenient to use.

SUMMARY OF THE INVENTION

The present invention is a portable door lock for use in securing an inward-opening door, thereby preventing intruders from entering an occupied room. The lock of the present invention may be folded when not in use for convenient carrying and storage.

The lock of the present invention comprises a flat bracket having a protrusion which can be inserted into a lock chamber of a doorframe. In a preferred embodiment, the protrusion is U-shaped. The bracket is connected by means of a hinge to a threaded bolt, upon which a hinged brace is slidably mounted. The hinged brace comprises a first member, or leg, which is adapted to be pressed against the door, pivotally connected to a second member, or leg, which is adapted to be pressed against the doorframe. A spring is mounted upon the first member and engages the second member, urging the second member away from the first member. The second member is provided with a stop which engages the first member and prevents the first and second members from pivoting away from each other at an angle greater than about 60°. A thumbwheel is mounted upon and threadably engages the threaded bolt, effectively retaining the hinged brace upon the threaded bolt.

When the protrusion is inserted in the lock chamber and the door is closed, the thumbwheel can be screwed down the threaded bolt towards the bracket. This urges the hinged brace towards the door and doorframe, pressing the first member against the door and the second member against the doorframe. The thumbwheel can then be tightened by hand, effectively locking the door. The inventive door lock can be quickly removed from the door by simply loosening the thumbwheel and spinning it up the threaded bolt away from the door.

The first member of the hinged brace is sized to fit within the second member and is also recessed to accept the threaded bolt when the hinged brace is closed by urging the first and second members together. In addition, the first and second members are shaped to form a slot positioned to accept and retain the protrusion in the bracket when the hinged brace is closed and the bracket is folded towards the threaded bolt. The inventive door lock can thus be folded simply by closing the hinged brace and folding the bracket towards the threaded bolt. The lock can then be held in this folded position by tightening the thumbwheel against the closed hinged brace.

In an alternative embodiment, the threaded bolt and thumbwheel may be replaced by a rod and locking member, the locking member being mounted upon the rod and being capable of locking to the rod at multiple positions along the rod.

The door lock of the present invention offers several advantages over previous portable door locks. As detailed below, due to the design of the lock, the force exerted on the door by someone attempting to enter the room is transferred to the doorframe where it counters the force exerted by the protrusion on the lock chamber. Furthermore, due to the hinge linkage between the bracket and the threaded bolt, no torsional stresses are placed on any of the components of the lock. The inventive lock is thus able to withstand the application of large forces to the outside of the door.

The lock is easy to use and can quickly be applied to or removed from a door. Due to the pivotal connection between the first and second members of the hinged brace, the lock is able to automatically adapt to differences in depth between the door and door frame. The lock may also be easily folded and held in a folded position for convenient carrying.

The above-mentioned and additional features of the present invention and the manner of obtaining them will become apparent, and the invention will be best understood by reference to the following more detailed description, read in conjunction with the accompanying drawings.

DETAILED DESCRIPTION

Figure 1:
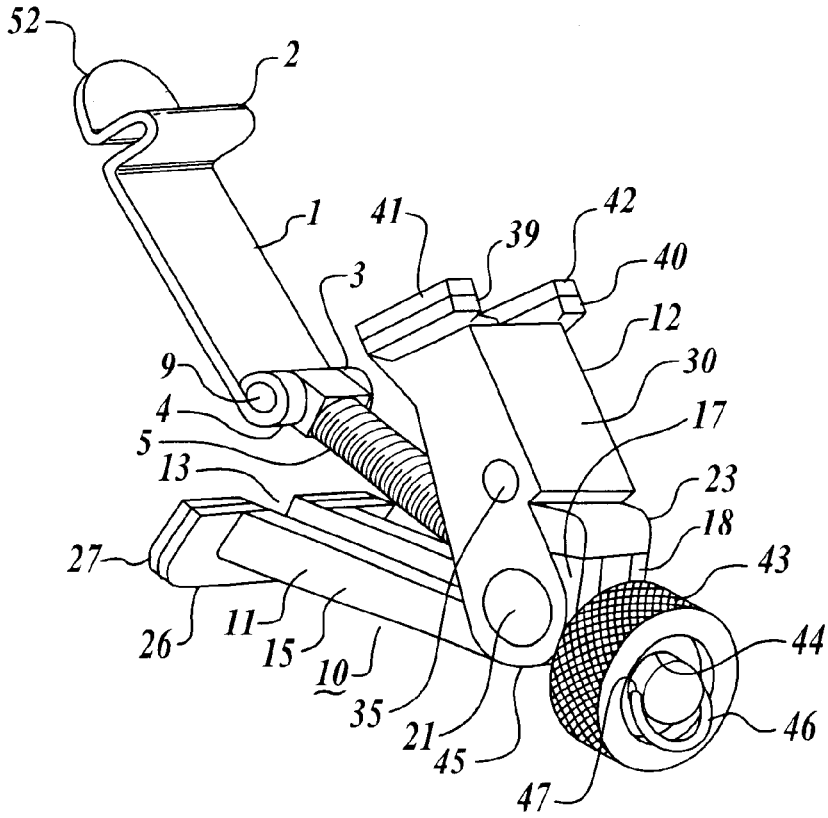
FIG. 1 is a perspective view of the inventive lock in an open position.
Figure 3:
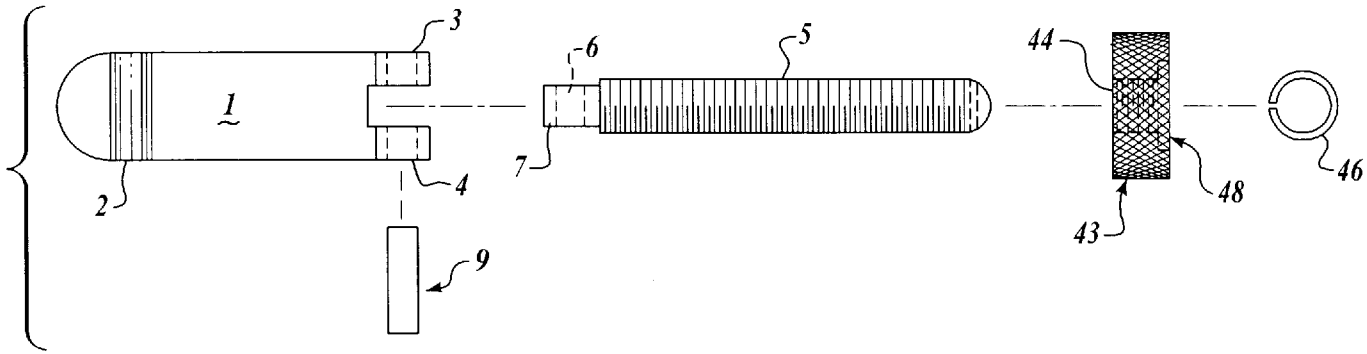
FIG. 3 is a exploded view of the bracket and threaded bolt.
Figure 4B:
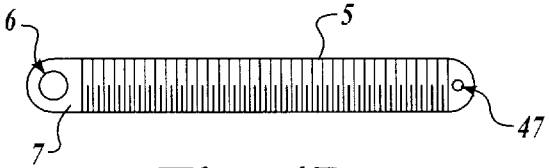
FIGS. 4A and 4B are side views of the bracket and threaded bolt, respectively.
Figure 4A:
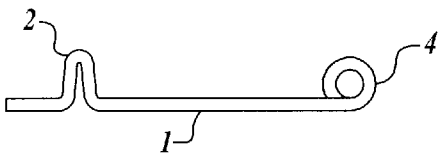

A portable lock of the present invention in the open position is shown in FIG. 1. The lock comprises a flat bracket 1, having at one end a narrow U-shaped protrusion 2 formed at 90° to its length. Protrusion 2 is preferably formed by folding bracket 1 over on itself in a double U bend. Bracket 1 is preferably constructed from high quality steel plate. However, other materials having similar strength, weight and rigidity to steel plate may also be employed to form bracket 1. Bracket 1 is hingably connected to threaded bolt 5. As shown in FIGS. 3 and 4, in a preferred embodiment, the end of bracket 1 is cut and rolled to form two hinge loops 3 and 4, the end of each loop 3 and 4 being welded to main bracket 1 to prevent loops 3 and 4 being unraveled under tensile stress. Threaded bolt 5 has a hole 6 bored through it at one end, with flats 7 and 8 being located on each side of threaded bolt 5 at 90° to the axis of hole 6, so that bolt 5 fits snugly between hinge loops 3 and 4 on main bracket 1. A pin 9, preferably formed from high tensile steel, is inserted through hole 6, connecting main bracket 1 to threaded bolt 5 and forming a swivel joint. Preferably, threaded bolt 5 is made of steel.

Figure 5B:
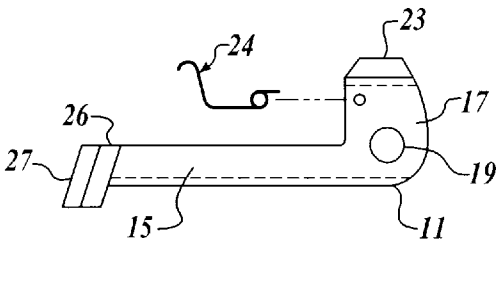
FIGS. 5A and 5B are top and side views, respectively, of an inner leg, or first member, of the hinged brace.
Figure 5A:
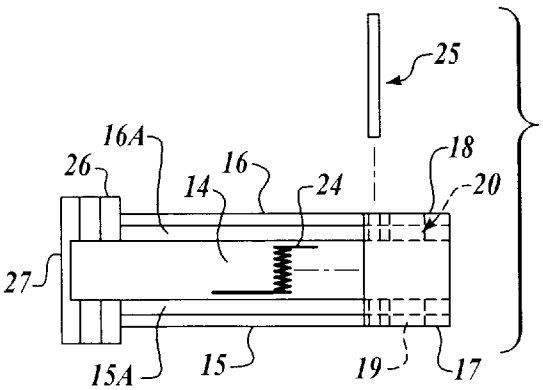

Over threaded bolt 5 slides a hinged brace 10 formed of two main parts, inner leg, or first member, 11 and outer leg, or second member, 12. Preferably, both inner leg 11 and outer leg 12 are formed from steel, or another material of similar rigidity and strength. As shown in FIGS. 5A and 5B, inner leg 11 has a recess 13 formed by base 14 and parallel sides 15 and 16, which extends along the entire length of inner leg 11 and within which threaded bolt 5 can rest when the lock is not in use. At the rear end of inner leg 11, sides 15 and 16 extend vertically to a height greater than that along the remaining length of inner leg 11, to form opposing protrusions 17 and 18. Preferably, protrusions 17 and 18 extend along approximately 25% of the length of inner leg 11 and are approximately twice the height of sides 15 and 16 at the opposing end of inner leg 11. Threaded holes 19 and 20 are drilled in line through protrusions 17 and 18, respectively. In a preferred embodiment, reinforcing plates 15A and 16A may be placed on the inner surfaces of sides 15 and 16, in order to increase the strength of inner leg 11. Reinforcing plates 15A and 16A preferably extend along the inner surfaces of protrusions 17 and 18. A similar reinforcing plate may be placed on the inner surface of base 14. Such plates exactly match the internal profile of inner leg 11 and have corresponding holes to match holes 19 and 20 in protrusions 17 and 18.

An abutment cap 23 is permanently attached to, and connects, the upper edges of protrusions 17 and 18. Preferably, abutment cap 23 is formed from solid steel and is welded to protrusions 17 and 18. Immediately below abutment cap 23, is located a spring 24. Spring 24 is retained in place by a pin 25 which passes through spring 24 and which extends at 90 degrees between protrusions 17 and 18. A flange plate 26 is rigidly connected to the front end of inner leg 11. A buffer pad 27 formed from compressible, non-slip material, preferably rubber, is connected to flange plate 26.

Figure 6A:
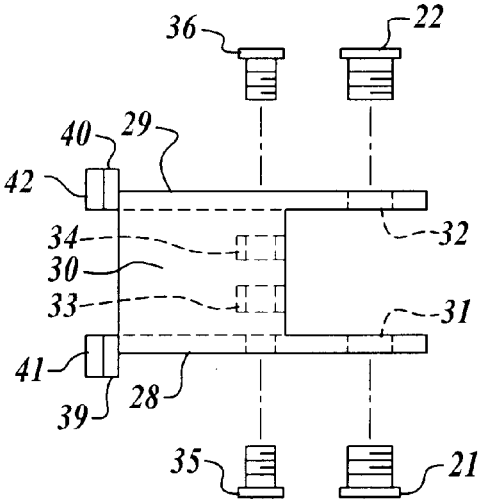
FIG. 6A is an exploded side view of an outer leg, of second member, of the hinged brace.
Figure 6B:
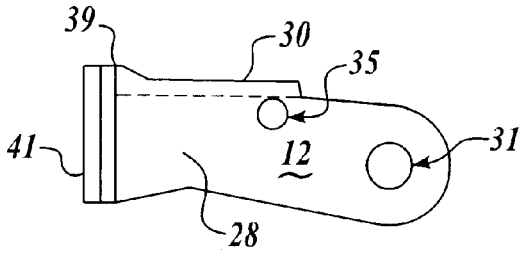
FIG. 6B is a side view of an outer leg.

As shown in FIGS. 6A and 6B, outer leg 12 comprises parallel vertical sides 28 and 29 connected by base 30, which preferably extends along approximately 50% of the length of sides 28 and 29. Outer leg 12 is sized to fit closely over sides 15 and 16 of inner leg 11 when hinged brace 10 is folded. Holes 31 and 32 are located at the rear ends of sides 28 and 29 to match holes 19 and 20 in inner leg 11. Hinge pivot screws 21 and 22 pass through holes 31 and 32 and into threaded holes 19 and 20 on protrusions 17 and 18, thereby pivotably connecting outer leg 12 to inner leg 11.

Figure 7:
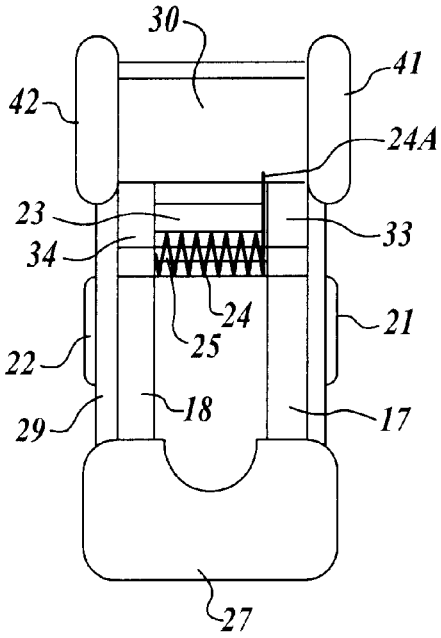
FIG. 7 is a front view of the hinged brace in an open position.

As shown in FIG. 7, one end 24A of spring 24 abuts and pushes against base 30 of outer leg 12, thereby opening hinged brace 10. Stops 33 and 34 are positioned on the inner surfaces of sides 28 and 29, respectively, adjoining the edge of base 30, and contact abutment 23 when hinged brace 10 is open thereby limiting the opening of hinged brace 10 to an angle less than about 80°, preferably less than about 75°. In one embodiment, stops 33 and 34 consist of nuts retained by screws 35 and 36 passing through holes 37 and 38 in sides 28 and 29. However, stops 33 and 34 made also be formed of rigid material, such as steel, securely fixed to sides 28 and 29 by, for example, welding. Flange plates 39 and 40 are rigidly connected to the front ends of sides 28 and 29, with buffer pads 41 and 42 of compressible, non-slip material, being connected to plates 39 and 40.

Threaded bolt 5 passes between protrusions 17 and 18 of inner leg 11, under abutment cap 23 and spring 24, with the end connected to bracket 1 being positioned at the front end of inner leg 11, so that hinged bracket 10 is movably positioned on threaded bolt 5. Hinged bracket 10 is retained on threaded bolt 5 by circular thumbwheel 43 which has a hole 44 passing through its axis. Hole 44 is sized and threaded to match the thread of threaded bolt 5, whereby, when turned, thumbwheel 43 moves down threaded bolt 5 and connects with the end 45 of hinged brace 10. Thumbwheel 43 preferably has a non-slip outer surface, for example knurled, in order to aid in griping it. In a preferred embodiment, thumbwheel 43 is formed from aluminum. As shown in FIGS. 3 and 4B, thumbwheel 43 is preferably retained on threaded bolt 5 by means of a small diameter split ring 46 which passes through a hole 47 in the rear end of threaded bolt 5. In the embodiment shown in FIG. 3, small depression 48 is provided in the upper surface of thumbwheel in which split ring 46 rests. It will be clear to one of skill in the art that thumbwheel 43 may be replaced by other locking means, such as a nut or screw.

Figure 8:
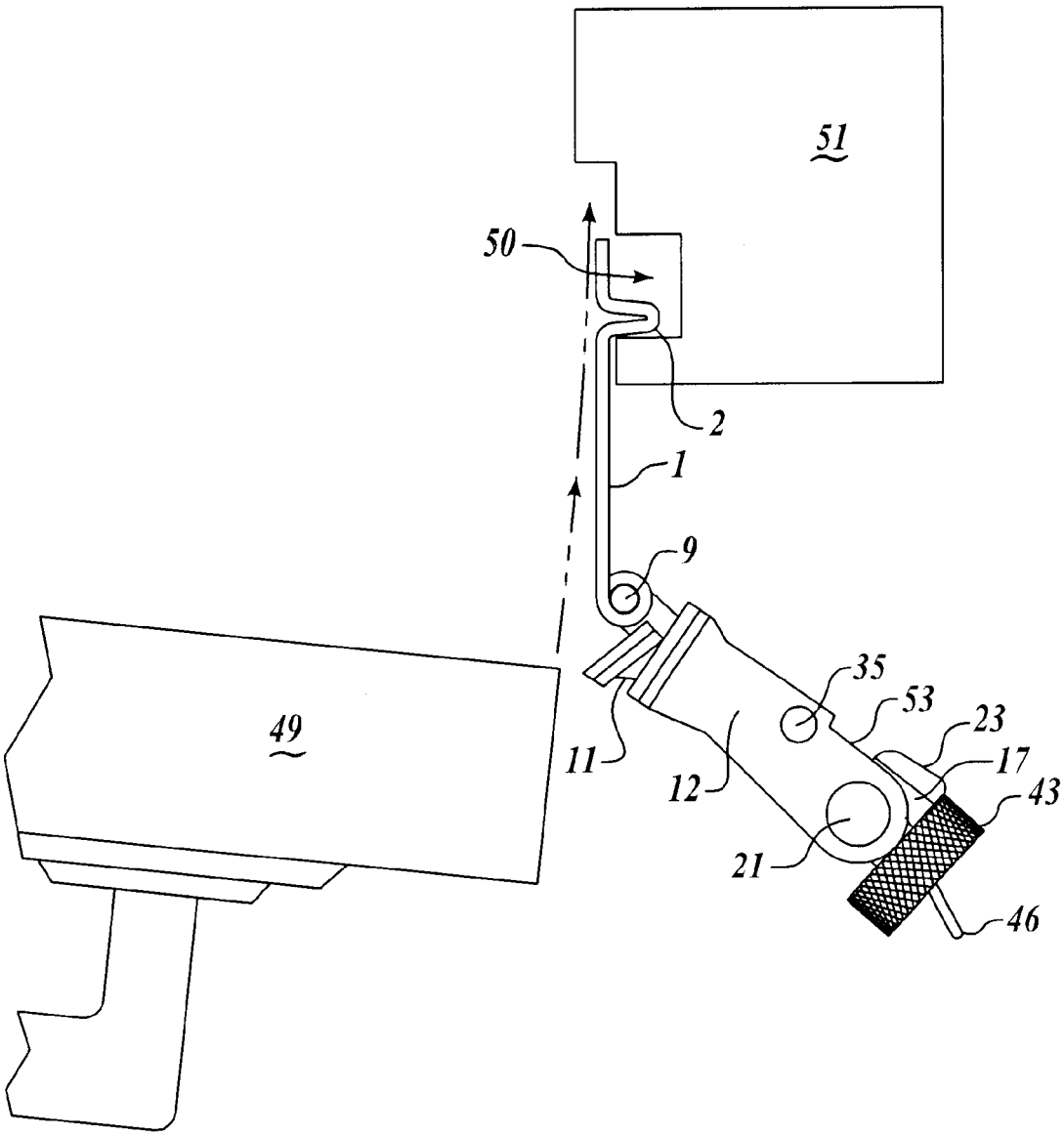
FIG. 8 is a top view showing application of the inventive lock to a door.
Figure 9:
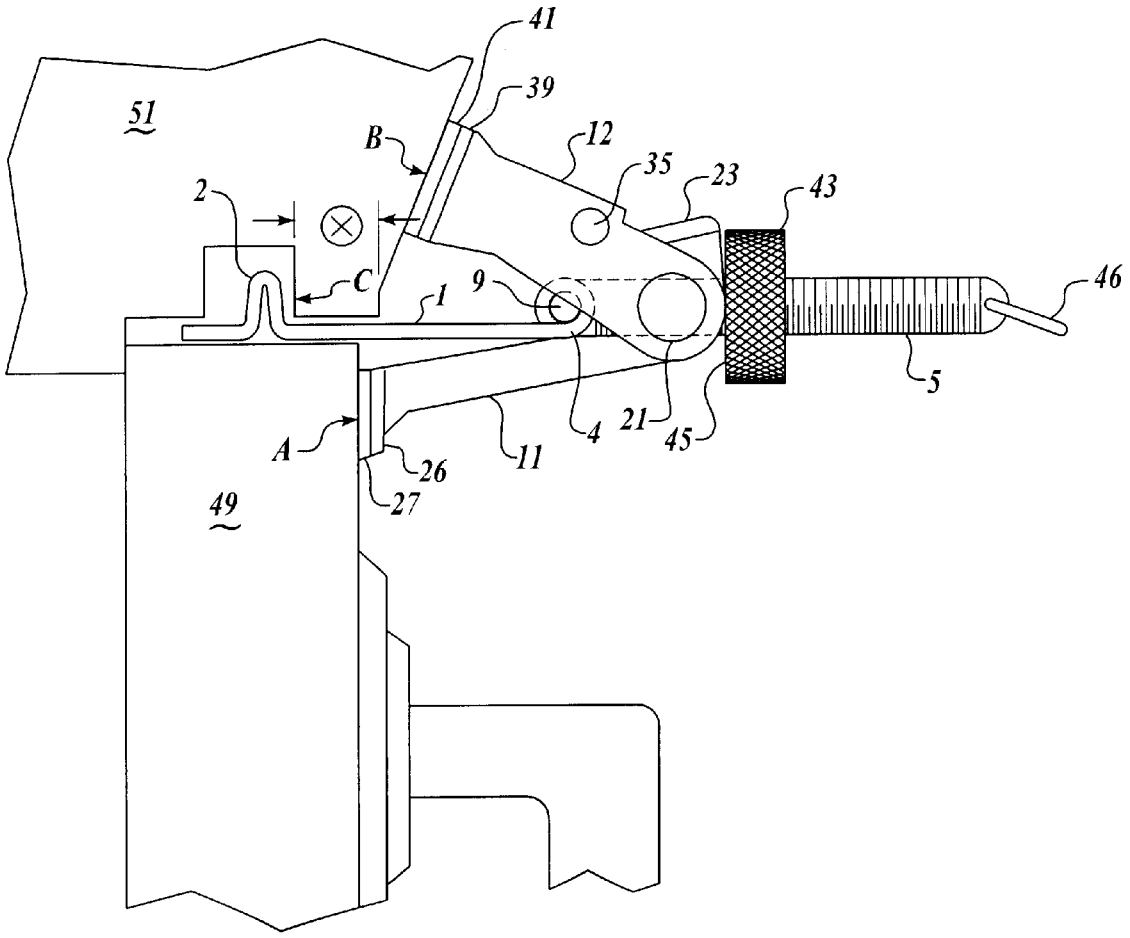
FIG. 9 is a top view of the inventive lock applied to a door.

With reference to FIGS. 8 and 9, in order to place the inventive lock on the inside of a door 49, inner leg 11 is held in one hand and door 49 is opened. U-shaped protrusion 2 on bracket 1 is placed in the lock chamber 50 in door frame 51. Hinged brace 10 is closed, preferably by pinching with the thumb and forefinger, swung away from door 49, and door 49 is closed. Hinged brace 10 is released, allowing it to spring open. Hinged brace 10 is then pushed forwards along threaded bolt 5 until buffer pad 27 on inner leg 11 touches door 49, and buffer pads 41 and 42 on outer leg 12 touch door frame 51. Thumbwheel 43 is rotated down threaded bolt 5 until it contacts end 45 of hinged brace 10 and is tightened by hand.

Figure 2:
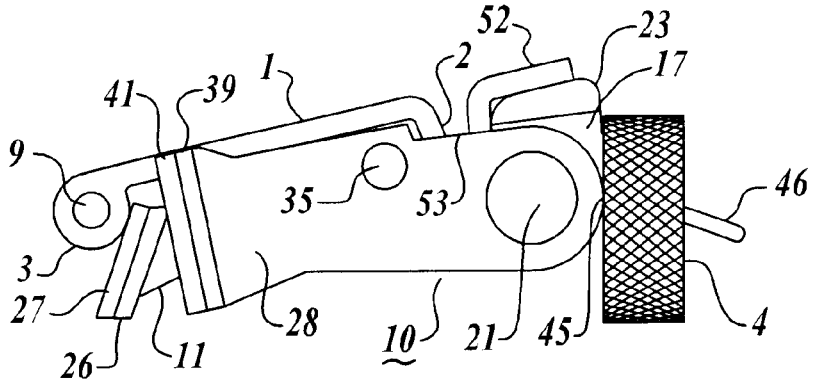
FIG. 2 is a side view of the inventive lock in a fully closed position.

To remove the inventive lock, thumbwheel 43 is loosened and rotated back up threaded bolt 5 until it contacts spilt ring 46. Hinged brace 10 is pulled away from door 49 until it contacts thumbwheel 43, pinched closed and swung away from door 49. Door 49 is opened and the lock is removed. The lock may then be folded, as shown in FIG. 2, as follows. While keeping hinged brace 10 closed, bracket 1 is folded over the top of outer leg 12 towards threaded bolt 5 and U-shaped protrusion 2 is engaged in slot 53 formed in closed hinged brace 10 between abutment cap 23 and the end of base 30. Thumbwheel 43 is then tightened against end 45, holding the lock in a compact form.

With reference to FIG. 9, when an attempt is made to open door 49 from the outside with the lock installed as described above, force is applied at point A to inner leg 11. This causes hinged brace 10 and threaded bolt 5 to pivot with respect to bracket 1 via hinge pin 9. The force is then applied through outer leg 12 directly into door frame 51 at point B.

The door lock of the present invention is stronger than previous portable door locks for two main reasons. First, by transferring the force on door 49 directly to door frame 51, it prevents any bending stresses from being applied to either bracket 1 or threaded bolt 5 and instead puts them both under tensile stress, which they are better able to withstand. Secondly, the force applied inwards to door frame 51 at point B opposes the force exerted outwards by U-shaped protrusion 2 on the inner edge of lock chamber 50 at point C. It is thickness X, between lock chamber 50 and the outer edge of door frame 51, that is the weakest point in most door and frame sets, and that is most likely to fail if a door is forced. Therefore, any force opposing that applied at point C will act to strengthen the door and frame set.

While in the foregoing specification this invention has been described in relation to certain preferred embodiments, and many details have been set forth for purpose of illustration, it will be apparent to those skilled in the art that the invention is susceptible to additional embodiments and that certain of the details described herein may be varied considerably without departing from the basic principles of the invention.

I claim:

1. A door lock comprising:

(a) a bracket having thereon a protrusion insertable into a lock chamber of a doorframe;

(b) a threaded bolt hingably connected to the bracket;

(c) a hinged brace slidably mounted upon the threaded bolt, the hinged brace comprising a first member adapted to be pressed against a door pivotally connected to a second member adapted to be pressed against the doorframe and a spring mounted on the first member and engaging the second member whereby the second member is urged away from the first member, the second member having at least one stop positioned thereon; and (d) a thumbwheel mounted upon and threadably engaging the threaded bolt, whereby when the thumbwheel is urged along the threaded bolt towards the bracket, the hinged brace is urged towards the door thereby pressing the first member against the door and the second member against the doorframe.

2. The door lock of claim 1, wherein the stop is positioned on the second member to engage the first member and prevent the first member from pivoting away from the second member at an angle greater than about 80 degrees.

3. The door lock of claim 1, wherein the protrusion in the bracket is U-shaped.

4. The door lock of claim 1, wherein the first member is sized to fit within the second member when the first and second members are urged together.

5. The door lock of claim 4, wherein the first member is recessed to accept the threaded bolt when the first and second members are urged together.

6. The door lock of claim 5, wherein the first and second members are shaped to form a slot positioned to accept and retain the protrusion in the bracket when the first and second members are urged together and the bracket is folded towards the threaded bolt.

7. The door lock of claim 1, wherein the thumbwheel is retained on the threaded bolt by means of a split ring.

8. The door lock of claim 1, wherein the bracket is formed from heavy gauge steel plate.

9. A door lock comprising:

(c) a bracket having thereon a protrusion insertable into a lock chamber of a doorframe;

(c) a rod hingably connected to the bracket;

(c) a hinged brace slidably mounted upon the rod, the hinged brace comprising a first member adapted to be pressed against a door pivotally connected to a second member adapted to be pressed against the doorframe and a spring mounted on the first member and engaging the second member, whereby the second member is urged away from the first member, the second member having at least one stop positioned thereon; and (d) a locking member mounted upon and engaging the rod, the locking member being lockably positionable at multiple locations along the length of the rod, whereby when the locking member is urged along the rod towards the bracket, the hinged brace is urged towards the door thereby pressing the first member against the door and the second member against the doorframe.

10. The door lock of claim 9, wherein the stop is positioned on the second member to engage the first member and prevent the first member from pivoting away from the second member at an angle greater than about 80 degrees.

11. The door lock of claim 9, wherein the protrusion in the bracket is U-shaped.

12. The door lock of claim 9, wherein the first member is sized to fit within the second member when the first and second members are urged together.

13. The door lock of claim 12, wherein the first member is recessed to accept the rod when the first and second members are urged together.

14. The door lock of claim 13, wherein the first and second members are shaped to form a slot positioned to accept and retain the protrusion in the bracket when the first and second members are urged together and the bracket is folded towards the rod.

15. The door lock of claim 9, wherein the bracket is formed from heavy gauge steel plate.

* * * * *